US006834857B2

(12) United States Patent
Lee et al.

(10) Patent No.: US 6,834,857 B2
(45) Date of Patent: Dec. 28, 2004

(54) GAME AND METHOD OF PLAYING

(76) Inventors: Sabing H. Lee, 60 Fern Pine, Irvine, CA (US) 92618; Henry P. Wong, 2800 Plaza Del Amo, #319, Torrance, CA (US) 90503

( * ) Notice: Subject to any disclaimer, the term of this patent is extended or adjusted under 35 U.S.C. 154(b) by 152 days.

(21) Appl. No.: 10/041,305

(22) Filed: Jan. 7, 2002

(65) Prior Publication Data

US 2002/0096829 A1 Jul. 25, 2002

Related U.S. Application Data

(60) Provisional application No. 60/263,904, filed on Jan. 24, 2001.

(51) Int. Cl.[7] ..... A63F 1/00

(52) U.S. Cl. ..... 273/292; 273/303; 273/308; 273/306

(58) Field of Search ..... 273/292, 293, 273/303, 304, 305, 306, 308, 274, 309; 463/13, 11, 12

(56) References Cited

U.S. PATENT DOCUMENTS 4,147,363 A * 4/1979 Lee et al. ..... 273/304
4,836,553 A * 6/1989 Suttle et al. ..... 273/292
5,522,595 A 6/1996 Wong
5,775,992 A * 7/1998 Wood et al. ..... 463/13
5,845,902 A 12/1998 Takemoto
6,003,869 A 12/1999 Kuo
6,012,981 A 1/2000 Fujioka et al.
6,224,484 B1 5/2001 Okuda et al.
6,312,334 B1 11/2001 Yoseloff
6,336,858 B1 * 1/2002 Yoseloff ..... 463/13

FOREIGN PATENT DOCUMENTS

WO WO 96/14118 5/1996

OTHER PUBLICATIONS

"That's It"—How to Play Mah Jongg with Playing Cards and Chinese Tiles by Dorothy S. Meyerson (1965/1966).

* cited by examiner

*Primary Examiner*—Benjamin Layno

(57) ABSTRACT

A new game incorporating Mah Jongg playing tiles or cards for use in a casino or other wagering or playing location is provided. This game preferably gives every participating player the opportunity to win for every hand dealt. Players may compete against a dealer or "the house," or may simply wager against the probability of obtaining certain hands. Games may be played for money or other stakes. Winning hands are preferably determined by obtaining certain designated combinations of playing units, and comparing these combinations against the hand of the dealer, or by determining whether the player's hand contains a predetermined group of winning combinations which provide winnings based on the probability in obtaining such combinations.

34 Claims, 3 Drawing Sheets

16

18

20

22

(B)

GAME AND METHOD OF PLAYING

CROSS-REFERENCE TO RELATED APPLICATION

This application claims the benefit of U.S. Provisional Application No. 60/263,904, filed Jan. 24, 2001.

BACKGROUND OF THE INVENTION

1. Field of the Invention

This invention relates to a game and method of playing, and more particularly relates to a game utilizing traditional Mah Jongg playing units adapted for play in a casino or other wagering or playing location.

2. Description of the Related Art

The Chinese game of Mah Jongg has been played in various forms for centuries. In its traditional form, a plurality of tiles are provided and distributed to four players, who then take and discard tiles to try to obtain a winning Mah Jongg hand. Winning hands are determined by having certain combinations of tiles. Traditional rules of playing are described in "That's It—How to Play Mah Jongg" by Dorothy S. Meyerson (1965), the entirety of which is hereby incorporated by reference.

The traditional forms of playing Mah Jongg are limited to four players, with only one player capable of winning per round. Players compete only against each other, so that every player is not able to win for every hand played. Accordingly, what is needed is an improved game of Mah Jongg which gives every player the opportunity to win. In additional, because of the immense popularity of the traditional Mah Jongg game, what is needed is a new game and method of playing that is profitable for a casino or other wagering location providing such game.

SUMMARY OF THE INVENTION

The preferred embodiments of the present invention satisfy the above needs by providing a new game incorporating Mah Jongg playing tiles or cards for use in a casino or other wagering or playing location. This game preferably gives every participating player the opportunity to win for every hand dealt. Players may compete against a dealer or "the house," or may simply wager against the probability of obtaining certain hands. Games may be played for money or other stakes. Winning hands are preferably determined by obtaining certain designated combinations of playing units, and comparing these combinations against the hand of the dealer, or by determining whether the player's hand contains a predetermined group of winning combinations which provide winnings based on the odds of probability of obtaining such combinations.

In one aspect of the present invention, a game and a method of playing a game are provided. The method comprises providing a plurality of cards, at least some of the cards being numbered in consecutive order, wherein for each numbered card in consecutive order, there are a plurality of substantially identical cards. A designated number of cards are distributed to at least one player. A designated number of cards are distributed to a dealer. It is then determined whether the cards distributed to the at least one player constitutes a winning hand, a winning hand being determined at least in part by:

(1) determining the number of winning sets contained in the cards distributed to the at least one player, wherein a winning set is selected from the group consisting of:
four substantially identical cards;
three substantially identical cards;
three consecutively numbered cards; and
two substantially identical cards.

(2) determining the number of winning sets contained in the cards distributed to the dealer; and (3) comparing the winning sets of the at least one player with the winning sets of the dealer.

In another aspect of the present invention, the game is played by providing a plurality of cards having traditional Mah Jongg symbols thereon. A designated number of the cards are distributed to at least one player. A designated number of the cards are distributed to a dealer. The cards of the at least one player are compared with the cards of the dealer to determine a winner. The winner has cards including at least one winning set, wherein a winning set is selected from the group consisting of four substantially identical cards, three substantially identical cards, three consecutively numbered cards, and two substantially identical cards.

In another aspect of the present invention, the game is played by providing a plurality of cards having traditional Mah Jongg symbols thereon and distributing a designated number of the cards to at least one player. It is determined whether the cards distributed to the at least one player constitutes a winning hand, a winning hand being determined at least in part by comparing the cards distributed to the at least one player against a predetermined list of winning hands and the probability of obtaining such hands. A sum of money or other prize is paid to the at least one player if the player has a winning hand.

In another aspect of the present invention, the game comprises a plurality of cards having traditional Mah Jongg symbols thereon. The plurality of cards includes a plurality of consecutively numbered cards, there being four substantially identical cards for each number, and a plurality of non-numbered cards, there being four substantially identical cards for each of said non-numbered cards. The game is played by distributing a designated number of cards to at least one player and a dealer. At least one winner is determined between the at least one player and the dealer by determining which of the at least one player and the dealer has more winning sets of cards or has a higher value winning set of cards as defined on a predetermined list of winning hand rankings. A winning set of cards may include, but is not limited to, four substantially identical cards, three substantially identical cards, three consecutively numbered cards and two substantially identical cards. When the at least one player is a winner, the at least one player is paid an amount by the dealer commensurate with a bet placed by the player. Additionally the winning amount may be increased by an amount based on the odds of obtaining the winning hand. When the dealer is a winner, the dealer collects from the player a bet placed by the player. In one embodiment, when the at least one player and the dealer have no winning hands or hands ranking below a certain level based on a predetermined list of winning hand rankings, neither the player or dealer would collect bets or winnings.

In one embodiment, the game is further played by distributing a designated number of cards to a plurality of players. The consecutively numbered cards are preferably numbered one through nine. The game in one embodiment is played by distributing an initial number of cards to the at least one player and the dealer, wherein in one embodiment, the initial number of cards is seven. In one embodiment, the at least one player is distributed an additional card after being distributed the initial number of cards. The additional card may be selected from previously undealt cards, or may be a card discarded by another player. In one embodiment, the at least one player is allowed to discard a card after being distributed an additional card. A second additional card can be distributed to the at least one player, and may be selected from previously undealt cards and may be a card used by all players. In one embodiment, when all of the cards distributed to the at least one player forms part of a winning set, the at least one player is an automatic winner. In another embodiment, when all of the cards distributed to the at least one player forms part of a winning set, the at least one player receives a bonus award based on a bonus bet placed by the player.

DETAILED DESCRIPTION OF THE PREFERRED EMBODIMENTS

The preferred embodiments of the present invention describe a method and apparatus for playing a new game using traditional Mah Jongg tiles or playing cards. It will be appreciated that multiple variations on the preferred game are contemplated. Accordingly, this invention should not be limited by the description of the preferred embodiments that follow.

The term "cards" as used herein is intended to encompass any unit of playing material, including but not limited to playing cards, tiles, cardboard, ivory, wood and catalin, and may be provided in either tangible or electronic form. Thus, the cards may be provided not only physically at a gaming location, but may also be provided electronically or wirelessly in a video gaming machine or electronically or wirelessly over the Internet or other computer server.

The term "player" includes any individual participating in the game, including the dealer in those embodiments where the dealer participates in the game.

The term "set" refers to a designated number of cards used by a player or dealer to form a preferred combination of cards.

The term "winning set" refers to a combination of cards, preferably numbering 2, 3 or 4 cards, wherein each of the cards of the set forms a desired combination, such as a "Pair," "Run," "Pung," or "Kong," defined below.

The term "hand" refers to the sum total of cards possessed by a player at any one time.

The term "Mah Jongg hand" refers to a hand possessed by a player designated to be a winning hand, wherein each of the cards in the hand forms part of a winning set.

In one embodiment, a game is provided for use as a casino table game. This casino game preferably allows for any number of players to play at one time, more preferably between 1 and 7. Additionally, this game can be played with a dealer also receiving cards, or with a player acting as the dealer or the bank.

The Deck

Figure 1A:
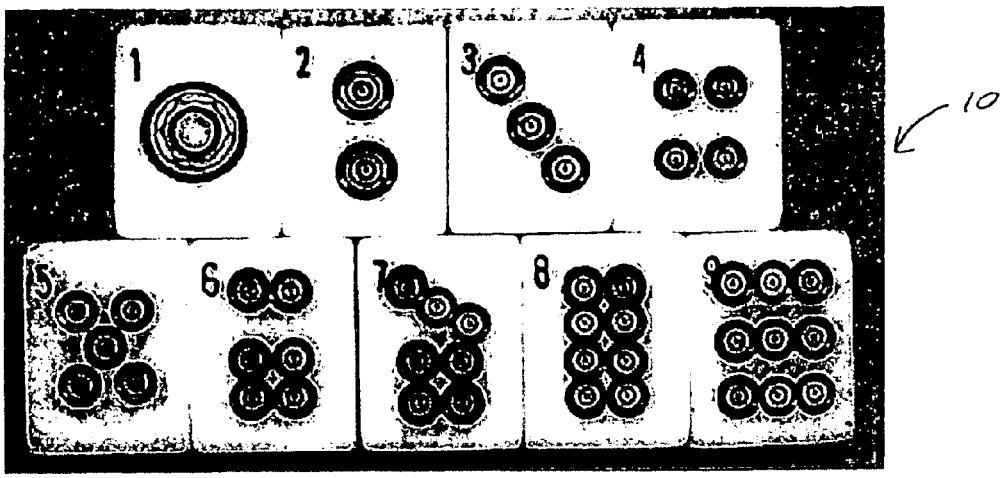
FIG. 1A illustrates the nine Number Cards constituting the Dot Cards in one embodiment of the present invention.

In one preferred embodiment, a deck of cards is provided having traditional Mah Jongg symbols imprinted thereon. One preferred composition of the deck includes 72 cards, as described below. In this composition, there are provided 36 "Number Cards" numbered from 1 to 9, there being four identical cards for each number. These cards may have traditional Mah Jongg indicators imprinted thereon. For example, as shown in FIG. 1A, nine "Dot Cards" 10 are illustrated with circles or dots imprinted thereon. The number of circles or dots on each card indicates the number of one through nine that the card is designated. As there are four of each of these cards, the sum total of Dot Cards in the preferred deck is 36.

Figure 1B:
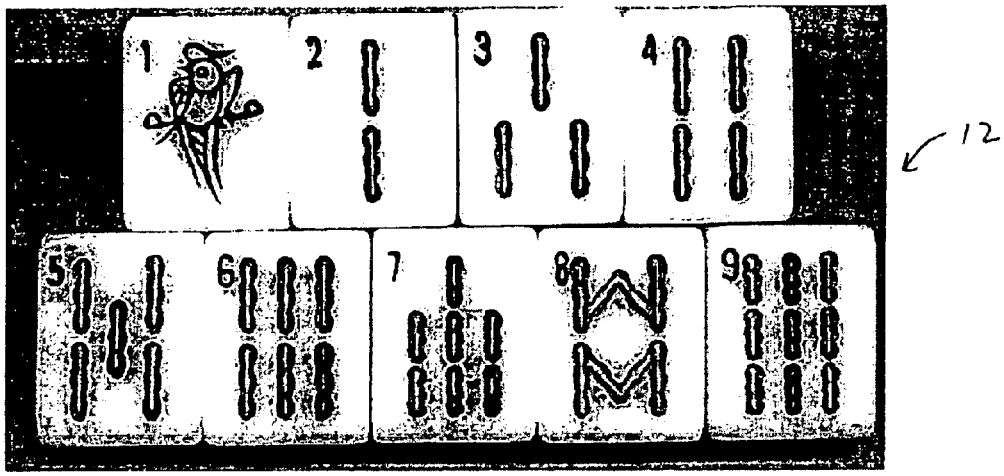
FIG. 1B illustrates the nine Number Cards constituting the Bam Cards in another embodiment of the present invention.
Figure 1C:
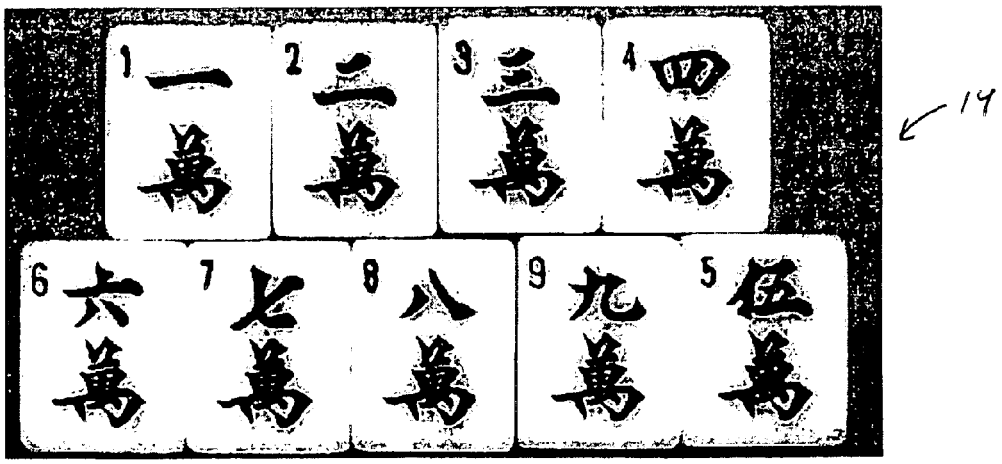
FIG. 1C illustrates the nine Number Cards constituting the Crak Cards in another embodiment of the present invention.

FIG. 1B illustrates an alternate embodiment where the 36 Number Cards are "Bamboo Cards" or "Barn Cards" 12, in which "bams" are imprinted on the cards. The number of "bams" on the cards designates the number of the card, where it is known that in the traditional game of Mah Jongg, the "One Bam" card is a bird. FIG. 1C illustrates an alternate embodiment where the 36 Number Cards are "Character Cards" or "Crak Cards" 14, in which "craks" are imprinted on the cards. The symbol for each of the "craks" is the Chinese character for the number designated.

It will be appreciated that any of a number of different indicators may be used to indicate the one through nine designations in the preferred deck. It will also be appreciated that a fewer number or greater number of cards may be provided for the Number Cards, and there may be more or fewer than four identical cards for each number. Furthermore, it will be appreciated that while in the preferred deck there is only one set of Dot Cards, Bam Cards or Character Cards, embodiments are contemplated in which two or all three of these sets are used in the deck. Moreover, the game may be played using different decks in successive rounds, wherein each of the three types of Number Cards are incorporated into the deck for successive rounds.

Figure 2:
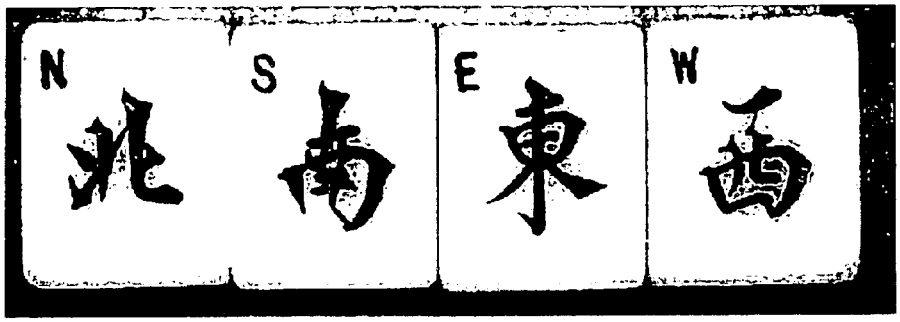
FIG. 2 illustrates the four Wind Cards in one embodiment of the present invention.

In addition to the 36 Number Cards described above, the preferred deck further includes a plurality of "Wind Cards" 16 illustrated in FIG. 2, designated North (N), South (S), East (E) and West (W). There are preferably 16 Winds, with four cards for each direction.

Figure 3:
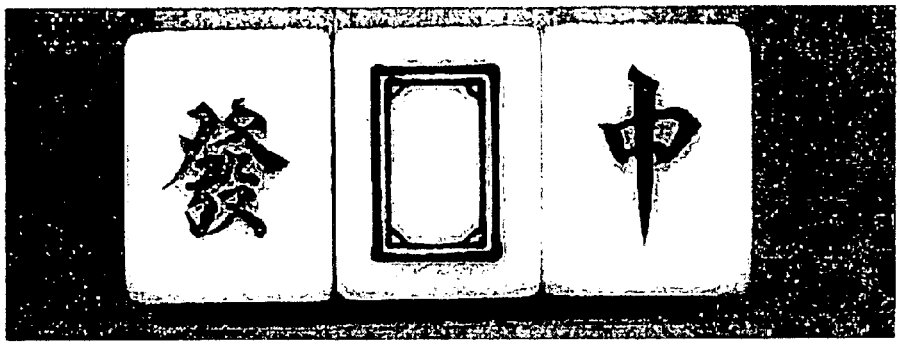
FIG. 3 illustrates the three Dragon Cards in one embodiment of the present invention.

FIG. 3 illustrates that the preferred deck also includes a plurality of "Dragon Cards" 18. There are preferably three types of dragons as shown in FIG. 3, more specifically the Green Dragon, the White Dragon and the Red Dragon (from left to right). There are preferably 4 each of these dragons, totaling 12 Dragon Cards.

It will be appreciated that the Dragon Cards and Wind Cards together are known as the "Honor Cards."

Figure 4:
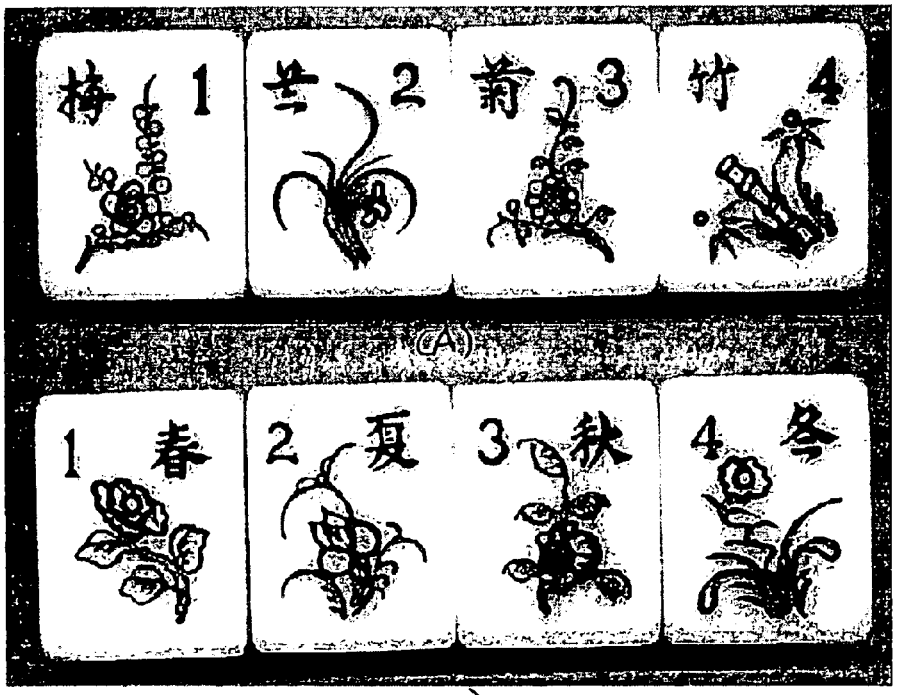
FIG. 4A illustrates the four Flower Cards in one embodiment of the present invention.
FIG. 4B illustrates four additional Flower Cards that may be used in an alternative embodiment of the present invention.

FIG. 4A illustrates four Flower Cards 20 included in the preferred deck. FIG. 4B illustrates that in one alternate embodiment, four additional Flower Cards may be provided. When four Flower Cards are used, the four cards preferably refer to the four seasons of Spring, Summer, Autumn, and Winter. There are preferably only one of each of these Flower Cards, totaling four Flower Cards. When eight Flower Cards are used, the four additional cards 22 can designate Fisher, Woodcutter, Farmer, and Scholar. Other embodiments of the game may include additional Flower Cards.

Figure 5:
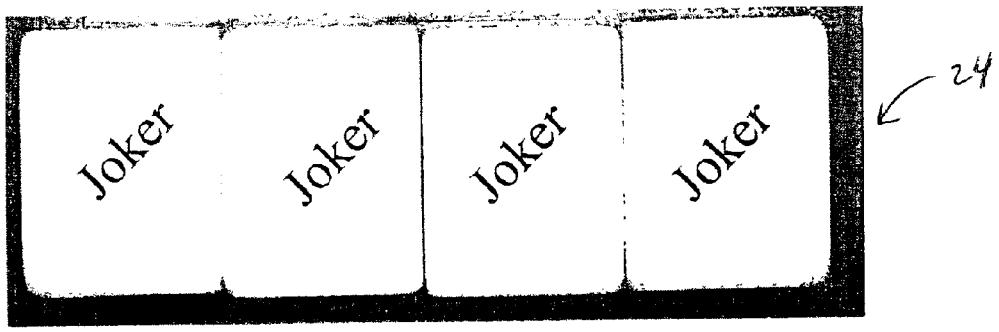
FIG. 5 illustrates the four Joker Cards in one embodiment of the present invention.

FIG. 5 illustrates the four Joker Cards 24 that are preferably included in the deck. As described below, these cards may preferably be used by a player to be any of the cards of the deck. Alternatively, the Joker Cards may be played in another version of the game as only capable of completing certain hands, such as a "Pung" or a "Run" as described below. Although four Joker Cards are illustrated as preferred, it will be appreciated that fewer or more Joker Cards may be used.

Thus, as described by FIGS. 1A–5 above, the 72 cards of one preferred deck include 36 Number Cards, 16 Wind Cards, 12 Dragon Cards, 4 Flower Cards and 4 Joker Cards. Again, it will be appreciated that the number and types of cards used for the deck is purely exemplifying, and accordingly, decks may be used for the game having different numbers and different types of cards.

Distribution of Cards

Figure 6:
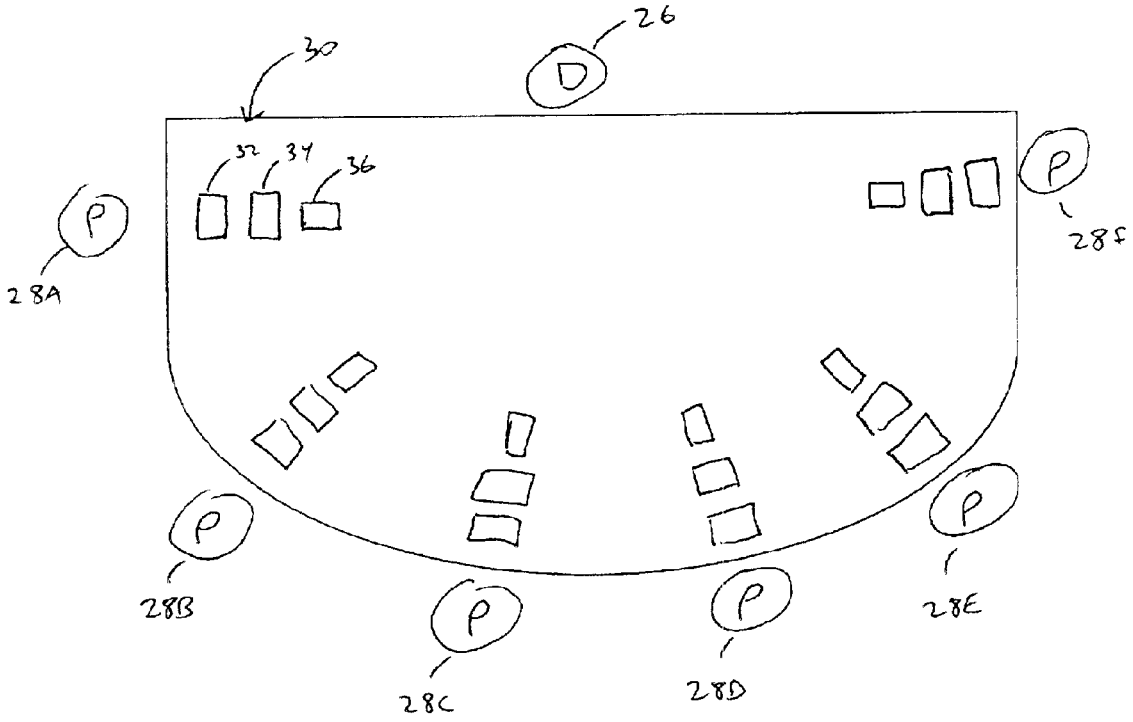
FIG. 6 is a schematic view of a casino table that may be used in accordance with one embodiment of the present invention.

In one preferred method of play, the 72 cards described above are shuffled, either by a dealer, a machine or one or more players. The cards are then preferably distributed to each of the players. For instance, as shown in FIG. 6, when a dealer 26 is dealing and there are 6 players 28A–28F sitting at a table 30, cards are dealt to each of the six players as well as the dealer. The individual who receives the cards first may be determined by a roll of one or more dice, by a random number generator, or by any other suitable method. A roll of the dice or other method may also be used to determine which cards from the deck are distributed first. In one preferred embodiment, a number of cards may be distributed face up such that all players may use those common cards as part of their hand.

The cards are preferably dealt in a counterclockwise manner around the table, with one individual receiving only one card before the next individual receives his or her card. This process in one embodiment goes around the table seven times until each individual receives 7 cards. The undealt cards remain in the deck. It will be appreciated that each individual could also receive all of his or her cards before the next individual receives his or her cards. It will also be appreciated that the individuals need not receive seven cards to play the game. Fewer or greater number of cards may be dealt, as described below.

It will also be appreciated that other methods for distributing the cards may be used. For instance, the players may receive their cards by selecting themselves from the deck, by laying the cards out before the players face down and allowing the players to select their own cards, or by building a traditional Mah Jongg "wall" and breaking the wall to receive the cards.

Winning the Game

Once the seven cards are dealt, the object of the game in one embodiment is to make certain definite combinations of cards to complete a hand. A "Mah Jongg hand" in one embodiment contains 8 cards made up of different combinations of Number Cards, Honor Cards, Flower Cards, and Joker Cards. In other embodiments where more or fewer than 7 cards are dealt, a winning "Mah Jongg hand" preferably contains a number of cards equal to a multiple of 3+2, e.g., 5 cards, 8 cards, 11 cards, 14 cards, 17 cards, etc. Other variations than those described below are also contemplated, including any of a number of combinations which are typically used to form a winning hand in a traditional Mah Jongg game.

In the embodiment where seven cards are dealt initially, the eighth card is preferably dealt after this initial distribution, as described below. Alternatively, the eight cards can be dealt to the player and dealer together initially.

When 8 cards are needed to obtain a "Mah Jongg hand," the cards are preferably grouped by the player either in two sets of three, and one set of two, or one set of four, and two sets of two. A winning set of three preferably contains three identical cards (a "Pung"), or three of the Number cards in consecutive order (a "Run"). For example, a winning set of three may include three identical "Green Dragons," or three "Bams" numbered 6, 7 and 8. A winning set of two preferably contains two identical cards (a "Pair"). Thus, one winning "Mah Jongg hand" includes both winning sets of three, as well as a winning set of two, such that every card in the hand is used in a winning set. Other winning sets are also contemplated, such as having four identical cards, known as a "Kong." Where players obtain a "Kong," a winning Mah Jongg hand may comprise two Kongs, or a Kong and two Pairs. Other possible winning sets include one of each Dragon, one of each Flower, or one of each Wind. It will be appreciated that for these types of winning sets, in one embodiment, each Dragon, Flower or Wind can be considered to be "substantially identical" to the other Dragons, Flowers or Winds, respectively.

In one preferred embodiment, only Numbered Cards can constitute a Run, while Honor Cards can only be used to form Pairs, Pungs or Kongs. In one embodiment, the Flower Cards may be used to form Pairs, Pungs or Kongs, it being appreciated that while the Flower Cards are not identical, they can be considered to be the same for the purpose of forming a winning set. Alternatively, the game may be played such that a player can exchange a Flower Card for an additional card, in which the case the Flower Card is preferably not played. Furthermore, the Flower Cards in one embodiment of the game may be used by the player to complete a Pung, Run or Kong only when the other cards of the set have already been obtained. The Joker Cards are preferably used to become any other card in the deck, or may be limited to use for completion of only certain sets, e.g., a Pair, Pung, Run or Kong, when the other cards of the set have already been obtained.

Sequence of Play

Play preferably begins by the first individual (who may be chosen by a roll of the dice or other method, as described above), taking a card from the undealt cards remaining in the deck. This card may be given to the player by the dealer, or may be selected by the player from all of the remaining cards in the deck. Alternatively, each player could simply be dealt the required 8 cards (or other desired number of cards needed to obtain a Mah Jongg hand) initially, without the need for taking a card after all of the cards are dealt.

In one optional embodiment, prior to the start of play and after the cards are dealt, there may be an exchange of cards to other individuals.

With the take of the first card in the preferred embodiment, the player now has 8 cards. If the player now has a "Mah Jongg hand" with the 8 cards, the player may declare "Mah Jongg" and the player has obtained a winning hand, and need not discard or take any further cards. If the player does not have a "Mah Jongg hand", the player may discard one of his unwanted cards.

In one embodiment, the discarded card is placed into a discarded pile and cannot be used by any other player. Each subsequent player then takes a card from the deck, and if that card does not give the player a winning "Mah Jongg hand," the player discards one of his unwanted cards.

In another embodiment, the discarded card of a player is exposed to all of the other players, who have the opportunity to claim the discarded card. In one embodiment, preference for claiming the discarded card is given to the next player in turn to the discarder. If no player wants the discarded card, the next player in turn can receive a card from those remaining in the deck. This player may keep the card and, if the card gives the player a winning "Mah Jongg hand," declare the "Mah Jongg hand." Alternatively, this player can discard either the card received or any other card in his hand. Play continues until each player is given the opportunity to either a discarded card or take a card from the deck.

After one round of taking and discarding cards, one or more additional rounds may continue, or play may stop. For instance, where 72 cards comprise the deck, a single round of taking and discarding cards is used. In one embodiment, the dealer does not take an additional card until after the last round in which the other players have taken and discarded their cards. Alternatively, the dealer can play the cards as any other player. When more than one round of taking and discarding cards is played, it may be advantageous to have more than 72 cards in the deck, incorporating more than one set of different Number Cards or additional other cards.

After completing the designated number of rounds for taking and discarding cards, a final round is preferably provided which gives the player the necessary 8 cards to complete the game. This final card may be a card selected from the deck for all of the players to use together. Alternatively, each player can again select or be dealt one card from the remaining card deck.

After the players assemble their eight cards, in one embodiment the players group their cards on the playing table into three stacks 32, 34 and 36, as shown in FIG. 6, preferably attempting to maximize the number of winning sets possessed. For example, each player preferably attempts to have two winning sets of three cards, and one winning set of two cards. Alternatively, when the player has obtained a "Kong," the player would preferably arrange the cards such that there is one winning set of four cards, and two winning sets of two cards each. Once all of the players put their cards on the table, the dealer preferably exposes his or her eight cards to the table, preferably in three groups. The dealer preferably arranges the cards to maximize his number of winning sets. The dealer may thus have no winning set, one winning set, two winning sets, or three winning sets (i.e., a Mah Jongg hand).

The dealer's hand is then compared to that of each of the players. In one embodiment, a winner is determined as between the individual player and the dealer according to who has more winning sets. Accordingly, if the dealer has two winning sets, and the player has one winning set of three, the dealer wins. If both the dealer and the player have two winning sets, a "push" is declared and there is no winner. In one embodiment, where comparing winning sets of two versus winning sets of three, if the dealer has only a winning set of two and the player has only a winning set of three, a push may be declared. Alternatively, the player may be declared the winner in this situation, having the more difficult hand to obtain.

Furthermore, in the situation where the dealer and player are comparing winning sets of three, it is also contemplated that a Pung may be declared a winner over a Run. Moreover, when both the dealer and player have a Mah Jongg hand, it will be appreciated that either the player or the dealer may be declared the automatic winner, or the play may be decided as a Push.

In game embodiments where winning sets can be formed by combination of cards other than sets of 2 and 3, it may be required to determine how different combinations would beat other combinations. For example, if a player has a Kong and a Pair and the Dealer has two sets of Pungs or Runs, this could be considered a Push.

The dealer proceeds to compare his or her hand to each of the players' hands to determine if the player wins, loses or pushes. Thus, in any one deal of the cards, multiple players can beat the dealer.

Betting

Betting in the preferred embodiments may take many forms. In one embodiment, the player places a wager of any amount, and wins if the player's hand has more winning sets than the dealer's, pushes if the player's hand has the same number of winning sets than the dealer's, and losers if the player's hand has a fewer number of winning sets than the dealer's. Furthermore, in one embodiment, if a player's set of three has a lower probability of occurring than that of the dealer's (e.g., a Pung versus a Run, a Kong versus a Pung or a Run, etc.), the player's set may also win in that situation. A winning hand preferably earns the player an amount equal to the amount of the bet. As described below, if a player obtains a Mah Jongg hand, this may earn the player a higher percentage of his bet, e.g., 150% or more. This higher percentage may be given if the player obtains the Mah Jongg hand without trading cards, or even if the player trades cards.

In another embodiment, the dealer can take a commission on all winning hands of the players, for example, 5% of the player's winning. Alternatively, no commission may be taken, but in this embodiment, the odds of winning the game may be made more in favor of the dealer, for example, by declaring the dealer the winner of certain ties, e.g., when two Mah Jongg hands are made by both the player and the dealer.

In another embodiment, the player may be required to match his or her initial bet or add more money to his or her bet to receive additional cards from the deck during play or from the discarded cards. In another embodiment, the player may start with two or more identical bets in front of him, and take back one of the bets for each additional card received from the deck or from the discarded cards. Alternatively, the player could be required to leave both bets in front of him to get an additional card, and may take one of his bets back if he does not want an additional card.

Progressive Betting and Scoring

In one embodiment, the player may be rewarded for obtaining a "Mah Jongg hand." For instance, a player who obtains a Mah Jongg hand may be paid a higher percentage of his bet, for example 3 to 2. This may be rewarded only if the player obtains this hand with his initial eight cards (or other designated number), or even if the player needs to take and discard for additional cards. The player may also be required to place a bonus bet to collect an additional reward on a "Mah Jongg hand" or other designated bonus hands. In this embodiment, for instance, the player may be required to bet an extra dollar (or unit) to receive the reward for the bonus hand. This dollar could be added to a progressive jackpot that is rewarded whenever a bonus hand (e.g., a "Mah Jongg hand") is received. Alternatively, the dollar could simply qualify the player to receive an amount based on the odds of obtaining a Mah Jongg hand. For instance, if the odds of obtaining a Mah Jongg hand were 10 to 1, the player could receive $10 for every $1 bet. The odds may vary depending on the type of Mah Jongg hand obtained, with certain more difficult or desired hands paying higher odds. Preferably, a winning player will be paid less than the true odds of the bet in order to allow the house or casino to profit from hosting the game.

Other possible progressive or odds-based payouts could be given for other combinations of cards, based on the odds of obtaining such cards. For example, higher payouts could be given for players who obtain one of each of the Dragon Cards, one of each of the Wind Cards or all of the Flower Cards. Furthermore, one embodiment of the game is contemplated where each round dealt by the dealer is designated as a certain Wind or Flower, and accordingly, any player who obtains a certain number of those Winds or Flowers (e.g., Pairs, Pungs or Kongs) may be awarded a bonus payout. Winning hands including all Dragon Cards, all Wind Cards, etc. may also be given larger payouts.

Variations

It will be appreciated that it is not necessary to use exactly the 72 cards of the preferred embodiment described above. For instance, it will be appreciated that the game can be played with or without the Wind Cards, Dragon Cards, Flower Cards, and/or Joker Cards. Furthermore, the game can also incorporate more than one set of the Number Cards, such that in one embodiment, 36 Dot Cards, 36 Bam Cards and 36 Character Cards are included in the deck. Another embodiment contemplated would have fewer or more than four each of the Number Cards, Wind Cards, Dragon Cards, Joker Cards, and/or Flower Cards.

Another alternative embodiment is contemplated wherein there is no discarding of cards, and play is based simply on the receipt of 8 cards (or other designated number) by the player.

Furthermore, an embodiment of the Mah Jongg game is contemplated in which the dealer does not play against the players, and winnings are determined based only on odds of obtaining a certain hand. Thus, the player could win based on the probability of obtaining one winning set, two winning sets, three winning sets, etc. Additionally, the amount won can be determined based on the probability of getting particular sets. Higher rewards would be paid for lower probability hands, such as a Mah Jongg hand, hands with Kongs, Pungs or Pairs of Honor Cards, etc. It will be appreciated that any of the hands that constitute winning hands in the traditional game of Mah Jongg may be used as the basis for determining whether a hand in the preferred games of the present invention constitutes a winning hand.

Furthermore, as in traditional Mah Jongg where higher points are scored for particular Mah Jongg hands obtained, higher odds may be given to players who receive these particular hands. Preferably, the casino can adjust these odds to ensure the casino an average payout that is more favorable to the casino. These odds may also be applied in the "Progressive Betting" embodiment above to give higher rewards for lower probability hands.

Slot Machine or Video Game Embodiments

In another embodiment of the invention, a slot machine type game is provided that incorporates principles from the traditional Chinese game of Mah Jongg. Basically, in any traditional slot machine payouts are given by having preferably three, four or five identical items in a horizontal row. In addition, when multiple coins are played, payouts may also be based on having identical items diagonally, vertically, or otherwise connected across the window.

A preferred embodiment incorporates traditional Mah Jongg characters as symbols used in a slot machine. Thus, in a slot machine having three items across a horizontal row, payouts may be given by having three identical Mah Jongg symbols appear in the row. These symbols may be any of the characters found in a traditional Mah Jongg game. Furthermore, for the non-numbered symbols used in the traditional game (e.g., the "Dragons," "Winds," and "Flowers"), higher payouts may be given when three identical ones of these symbols appear in the row. In another embodiment, payouts may be given by having three consecutively numbered symbols appear across the horizontal row. Jokers or Flowers may be used as "wild cards" to complete winning sets and/or provide higher payouts.

Another embodiment contemplated involves play with multiple coins. In this embodiment, multiple horizontal rows of symbols may appear in the slot machine window. For example, in a three column slot machine, playing two coins would allow play in two rows (and thus, six symbols), and playing three coins would allow play in three rows (and thus, nine symbols). Payouts can be based on whether any of the rows produces a traditional winning set, e.g., a "Run" (three consecutively numbered symbols) or a "Pung" (three identical symbols). Alternatively, payouts can be based on whether all of the rows played together form one or more of these winning sets, regardless of whether they are aligned in a horizontal row or other desired pattern.

In one embodiment of a slot machine game, multiple coins may be played in a machine having multiple horizontal lines and 3 or more columns. In one particular embodiment, up to 9 or more coins may be played, with the machine displaying 5 horizontal lines. In one preferred embodiment, each horizontal line has 5 vertical columns to form a square matrix. In other embodiments, each horizontal line may have anywhere from 3 to 8 columns or more, to accommodate formation of one or more combinations of winning sets as defined above. For example, any 3×+2 matrix sized matrix could be used. The first five coins played preferably correspond to each of the horizontal lines. Coins 6–9 or more correspond to different zig-zag lines formed across the window in various patterns. Hands could also be made straight down the columns.

Possible symbols in the slot machine window could be chosen from the preferred 72 card deck described above. Alternatively, more combinations could be provided by incorporating all of the Number Cards. Other combination of possible symbols are contemplated as well.

Payouts are made depending on the probability of getting certain hands for each of the coins played. All winning hands are preferably paid immediately. In one embodiment, in hands that are short, one or more cards may move to a second round where a player may elect to buy additional cards for additional coins. In one embodiment, after the player plays the initial spin, a player could choose a card to discard and pay for an additional card. Alternatively, similar to the traditional Mah Jongg game, a player could receive the additional card first and then choose which card to discard. This process could continue until the player receives a winning hand. In another embodiment, a first coin may allow a number of free draws, with additional coins used to pay for additional draws after that.

Other aspects of the casino table embodiment described above may also be incorporated into a slot machine or other video betting game, and vice versa. For example, payouts may be given when certain symbols appearing in the slot machine or video window constitute a winning set, or when all of the symbols constitute a Mah Jongg hand.

Additional embodiments of a video game could incorporate morphing dragons that change from red green or white depending on what's favorable to the players hand, and animated cards like blooming flowers and fishing fishermen. Video game embodiments may incorporate a touch screen or a pen wand interface.

In one embodiment, a simple 3 spot slot is provided with a limited card pool. A fourth card could be drawn after the initial pull of the slot (or other method of drawing the initial three cards). If the fourth card is a designated "special card,"

an extra payout could be given. For example, a player who "pulls" a fourth card dragon or flower could be paid double or triple. The fourth could card also be used to complete a standard three card winning set, as described above.

It should be understood that certain variations and modifications of this invention will suggest themselves to one of ordinary skill in the art. For example, the invention is not necessarily limited to using Mah Jongg symbols. The scope of the present invention is not to be limited by the illustrations or the foregoing descriptions thereof, but rather solely by the appended claims.

What is claimed is:

1. A method of playing a game, comprising:

providing a plurality of cards, at least some of said cards being numbered in consecutive order, wherein for each numbered card in consecutive order, there are a plurality of substantially identical cards;

distributing a designated number of cards to at least one player to form a player hand;

distributing a designated number of cards to a dealer to form a dealer hand; and determining whether the cards distributed to the at least one player forming the player hand constitutes a winning hand, a winning hand being determined at least in part by:

determining the number of winning sets contained in the cards distributed to the at least one player forming the player hand, wherein a winning set is selected from the group consisting of:

four substantially identical cards;

three substantially identical cards;

three consecutively numbered cards; and two substantially identical cards;

determining the number of winning sets contained in the cards distributed to the dealer forming the dealer hand; and comparing the number of winning sets of the at least one player with the number of winning sets of the dealer.

2. The method of claim 1, wherein the plurality of cards have traditional Mah Jongg symbols thereon.

3. The method of claim 1, wherein distributing a designated number of cards to the at least one player comprises distributing an initial number of cards to the at least one player, and subsequently distributing one additional card to the at least one player.

4. The method of claim 3, wherein the additional card is distributed to the at least one player by selecting the card from a plurality of previously undistributed cards.

5. The method of claim 3, wherein the additional card distributed to the at least one player is a card that has been discarded by another player.

6. The method of claim 1, wherein for each numbered card in consecutive order, there are four substantially identical cards.

7. The method of claim 1, wherein the numbered cards are consecutive from one to nine.

8. The method of claim 1, wherein the plurality of cards further includes a plurality of non-numbered cards, wherein for each non-numbered card, there are four substantially identical cards.

9. The method of claim 1, wherein the designated number of cards is the sum of a multiple of three+2.

10. The method of claim 9, wherein the designated number of cards is 5.

11. The method of claim 9, wherein the designated number of cards is 8.

12. The method of claim 1, wherein comparing the winning sets comprises determining whether the at least one player has more winning sets than the dealer.

13. The method of claim 1, wherein a designated number of cards is distributed to a plurality of players.

14. The method of claim 1, further comprising, for each player distributed cards that constitutes a winning hand, paying that player an amount commensurate with a wager made by that player.

15. The method of claim 1, further comprising determining whether every card distributed to the at least one player forms part of a winning set.

16. The method of claim 15, further comprising paying a player having every card forming part of a winning set an amount based on the probability of obtaining the particular set of cards distributed to that player.

17. The method of claim 1, wherein the game is played in a casino.

18. The method of claim 17, wherein the casino takes a percentage of every hand won by the at least one player.

19. The method of claim 1, wherein the game is played on a video machine.

20. The method of claim 1, wherein the game is played over the Internet.

21. A method of playing a game, comprising:

providing a plurality of cards having traditional Mali Jongg symbols thereon;

distributing a designated number of the cards to at least one player to form a player hand;

distributing a designated number of the cards to a dealer to form a dealer hand;

comparing the cards of the at least one player forming the player hand with the cards of the dealer forming the dealer hand to determine a winner, a winning hand being determined at least in part by determining the number of winning sets contained in the cards distributed to the at least one player forming the player hand, and comparing said number of winning sets contained in the cards distributed to the at least one player forming the player hand with the number of winning sets contained in the cards distributed to the dealer forming the winning hand, wherein a winning set is selected from the group consisting of:

four substantially identical cards;

three substantially identical cards;

three consecutively numbered cards; and two substantially identical cards.

22. The method of claim 21, wherein the plurality of cards includes a plurality of numbered cards, there being four substantially identical cards for each numbered card.

23. The method of claim 22, wherein the plurality of cards includes a plurality of non-numbered cards, there being four substantially identical cards for each non-numbered card.

24. The method of claim 21, wherein the winner has more winning sets than that of the dealer.

25. The method of claim 21, further comprising distributing a designated number of cards to a plurality of players, and comparing the cards of each of the plurality of players with the cards of the dealer to determine one or more winners.

26. The method of claim 21, wherein the plurality of cards includes distinct groups of cards each having the same Mah Jongg symbol thereon, the Mah Jongg symbol for one group being different from the Mah Jongg symbol of another group, wherein for each group of cards having the same Mah Jongg symbol thereon, there is provided at least three identical cards for every card in said group.

27. The method of claim 26, wherein a winning set is selected from the group consisting of:

four identical cards having the same Mah Jongg symbol thereon;

three identical cards having the same Mah Jongg symbol thereon;

three consecutively numbered cards having the same Mah Jongg symbol thereon; and two identical cards having the same Mah Jongg symbol thereon.

28. A method of playing a game, comprising:

providing a plurality of cards having traditional Mah Jongg symbols thereon, the plurality of cards including distinct groups of cards each having the same Mah Jongg symbol thereon, the Mah Jongg symbol for one group being different from the Mah Jongg symbol of another group, wherein for each group of cards having the same Mah Jongg symbol thereon, there is provided at least three identical cards for every card in said group;

distributing a designated number of the cards to at least one player to form a player hand;

determining whether the cards distributed to the at least one player forming the player hand constitutes a winning hand, a winning hand being determined at least in part by determining whether the cards distributed to the at least one player forming the player hand contain a desired number of winning sets, a winning set containing a pre-selected combination of cards; and paying a sum of money or other prize to the at least one player if the player has the desired number of winning sets, said payment being determined at least in part by the probability of obtaining the desired number of winning sets.

29. The method of claim 28, wherein a winning set selected from the group consisting of:

four identical cards having the same Mah Jongg symbol thereon;

three substantially identical cards having the same Mah Jongg symbol thereon;

three consecutively numbered cards having the same Mah Jongg symbol thereon; and two identical cards having the same Mah Jongg symbol thereon.

30. The method of claim 28, wherein a winning hand is determined by having every card distributed to the at least one player forming part of a set of cards selected from the group consisting of:

four identical cards having the same Mah Jongg symbol thereon;

three identical cards having the same Mah Jongg symbol thereon;

three consecutively numbered cards having the same Mah Jongg symbol thereon; and two identical cards having the same Mah Jongg symbol thereon.

31. The method of claim 28, wherein the sum of money paid is based at least in part on the probability of obtaining such cards.

32. The method of claim 28, wherein the distinct groups include a first group wherein each card has a "Bam" symbol thereon, a second group wherein each card has a "Crack" symbol thereon, and a third group wherein each card has a "Dot" symbol thereon.

33. The method of claim 32, wherein the distinct groups further include groups wherein each card has an Honor symbol thereon.

34. The method of claim 28, wherein for each group of cards having the same Mah Jongg symbol thereon, there is provided four identical cards for every card in said group.

* * * * *

UNITED STATES PATENT AND TRADEMARK OFFICE

CERTIFICATE OF CORRECTION

PATENT NO. : 6,834,857 B2 
DATED : December 28, 2004
INVENTOR(S) : Sabing H. Lee and Henry P. Wong It is certified that error appears in the above-identified patent and that said Letters Patent is hereby corrected as shown below:

Column 12,
Line 26, "Mali" and insert -- Mah --.
Line 37, after "player hand" delete ",".

Column 13,
Line 37, before "selected" insert -- is --.

Column 14,
Line 3, after "three" delete "substantially".

Signed and Sealed this

Thirtieth Day of May, 2006

JON W. DUDAS
*Director of the United States Patent and Trademark Office*